US006585348B2

(12) United States Patent
Reed et al.

(10) Patent No.: US 6,585,348 B2
(45) Date of Patent: Jul. 1, 2003

(54) INKJET PRINTER CARTRIDGE ADAPTED FOR ENHANCED CLEANING THEREOF AND METHOD OF ASSEMBLING THE PRINTER CARTRIDGE

(75) Inventors: Douglas J. Reed, Corvallis, OR (US); Paul David Gast, Camas, WA (US); Kenneth J Courian, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 60 days.

(21) Appl. No.: 10/003,619

(22) Filed: Oct. 29, 2001

(65) Prior Publication Data

US 2003/0081050 A1 May 1, 2003

(51) Int. Cl.[7] ..... B41J 2/165
(52) U.S. Cl. ..... 347/29; 347/33
(58) Field of Search ..... 347/29, 33, 22, 347/47

(56) References Cited

U.S. PATENT DOCUMENTS

| | | | | |
|---|---|---|---|---|
| 3,946,398 A | | 3/1976 | Kyser et al. | |
| 4,381,946 A | | 5/1983 | Uehara et al. | |
| 4,500,895 A | | 2/1985 | Buck et al. | |
| 4,771,295 A | | 9/1988 | Baker et al. | |
| 4,794,409 A | | 12/1988 | Cowger et al. | |
| 5,278,584 A | | 1/1994 | Keefe et al. | |
| 5,487,728 A | | 1/1996 | Vaillancourt | |
| 5,610,640 A | * | 3/1997 | Anderson et al. | 347/32 |
| 5,907,335 A | | 5/1999 | Johnson et al. | |
| 6,193,357 B1 | | 2/2001 | Medin | |
| 6,206,499 B1 | | 3/2001 | Iijima et al. | |
| 6,290,324 B1 | | 9/2001 | Jackson et al. | |
| 6,350,012 B1 | * | 2/2002 | Sarkissian et al. | 347/46 |
| 6,422,680 B1 | * | 7/2002 | Hayakawa et al. | 347/30 |

OTHER PUBLICATIONS

Hewlett–Packard Journal, Aug. 1988.

* cited by examiner

*Primary Examiner*—Thinh Nguyen
(74) *Attorney, Agent, or Firm*—Walter S. Stevens

(57) ABSTRACT

An inkjet printer cartridge adapted for enhanced cleaning thereof, and method of assembling the printer cartridge. An inkjet printer cartridge comprises a cartridge body defining a chamber therein. A substrate is coupled to the cartridge body and has a hole therethrough in communication with the chamber. An orifice plate is coupled to the substrate and has an orifice therethrough aligned with the hole. A platform is coupled to the substrate and surrounds the orifice plate. The platform defines a relatively smooth surface thereon having a predetermined surface roughness for sealably engaging a cap belonging to a print head cleaning service station movable into engagement with the printer cartridge. The surface of the platform may have a surface roughness of between approximately 0.5 microinches and approximately 2.0 microinches. Moreover, the surface of the platform is also level for sealably engaging the cap.

20 Claims, 8 Drawing Sheets

INKJET PRINTER CARTRIDGE ADAPTED FOR ENHANCED CLEANING THEREOF AND METHOD OF ASSEMBLING THE PRINTER CARTRIDGE

BACKGROUND OF THE INVENTION

The present invention generally relates to printer cartridges and methods and more particularly relates to an inkjet printer cartridge adapted for enhanced cleaning thereof, and method of assembling the printer cartridge.

An ink jet printer produces images on a recording medium by ejecting ink droplets onto the recording medium in an image-wise fashion. The advantages of non-impact, low-noise, low energy use, and low cost operation in addition to the ability of the printer to print on plain paper are largely responsible for the wide acceptance of ink jet printers in the marketplace.

In this regard, an ink jet printer comprises a print head cartridge that includes a plurality of ink ejection chambers and a plurality of ink ejection orifices in communication with respective ones of the ink ejection chambers. At every orifice a pressurization actuator is used to produce an ink droplet. In this regard, either one of two types of actuators may be used. These two types of actuators are heat actuators and piezoelectric actuators. With respect to piezoelectric actuators, a piezoelectric material is used. The piezoelectric material possesses piezoelectric properties such that an electric field is produced when a mechanical stress is applied. The converse also holds true; that is, an applied electric field will produce a mechanical stress in the material. Some naturally occurring materials possessing this characteristic are quartz and tourmaline. The most commonly produced piezoelectric ceramics are lead zirconate titanate, lead metaniobate, lead titanate, and barium titanate. When a piezoelectric actuator is used for inkjet printing, an electric pulse is applied to the piezoelectric material causing the piezoelectric material to bend, thereby squeezing an ink droplet from an ink body in contact with the piezoelectric material. The ink droplet thereafter travels toward and lands on the recording medium. One such piezoelectric inkjet printer is disclosed by U.S. Pat. No. 3,946,398 titled "Method And Apparatus For Recording With Writing Fluids And Drop Projection Means Therefor" issued Mar. 23, 1976 in the name of Edmond L. Kyser, et al.

With respect to heat actuators, such as found in thermal ink jet printers, a heater locally heats the ink body and a quantity of the ink phase changes into a gaseous steam bubble. The steam bubble raises the internal ink pressure sufficiently for an ink droplet to be expelled towards the recording medium. Thermal inkjet printers are well-known and are discussed, for example, in U.S. Pat. No. 4,500,895 to Buck, et al.; U.S. Pat. No. 4,794,409 to Cowger, et al.; U.S. Pat. No. 4,771,295 to Baker, et al.; U.S. Pat. No. 5,278,584 to Keefe, et al.; and the Hewlett-Packard Journal, Vol. 39, No. 4 (August 1988), the disclosures of which are all hereby incorporated by reference.

The print head cartridge itself may be a carriage mounted print head cartridge that reciprocates transversely with respect to the recording medium (i.e., across the width of the recording medium) as a controller connected to the print head cartridge selectively fires individual ones of the ink ejection chambers. Each time the print head traverses the recording medium, a swath of information is printed on the recording medium. After printing the swath of information, the printer advances the recording medium the width of the swath and the print head cartridge prints another swath of information in the manner mentioned immediately hereinabove. This process is repeated until the desired image is printed on the recording medium. Alternatively, the print head cartridge may be a page-width print head cartridge that is stationary and that has a length sufficient to print across the width of the recording medium. In this case, the recording medium is moved continually and normal to the stationary print head cartridge during the printing process.

Inks useable with piezoelectric and thermal ink jet printers, whether those printers have carriage-mounted or page-width print head cartridges, are specially formulated to provide suitable images on the recording medium. Such inks typically include a colorant, such as a pigment or dye, and an aqueous liquid, such as water, and/or a low vapor pressure solvent. More specifically, the ink is a liquid composition comprising a solvent or carrier liquid, dyes or pigments, humectants, organic solvents, detergents, thickeners, preservatives and other components. Moreover, the solvent or carrier liquid may be water alone or water mixed with water miscible solvents such as polyhydric alcohols, or organic materials such as polyhydric alcohols. Various liquid ink compositions are disclosed, for example, by U.S. Pat. No. 4,381,946 titled "Ink Composition For Ink-Jet Recording" issued May 3, 1983 in the name of Masafumi Uehara, et al.

Such inks for inkjet printers, whether of the piezoelectric or thermal type, have a number of special characteristics. For example, the ink should incorporate a nondrying characteristic, so that drying of the ink in the ink ejection chambers is hindered or slowed to such a state that by occasional spitting of ink droplets, the ejection chambers and corresponding orifices are kept open and free of dried ink. Of course, the inkjet print head cartridge is exposed to the environment where the inkjet printing occurs. Thus, the previously mentioned orifices are exposed to many kinds of air born particulates, such as dust, dirt and paper fibers. Particulate debris may accumulate on surfaces formed around the orifices and may accumulate in the orifices and chambers themselves. That is, the ink may combine with such particulate debris to form an interference burr those blocks the orifice or that alters surface wetting to inhibit proper formation of the ink droplet. Blocking the orifice interferes with proper ejection of ink droplets, thereby altering the flight path of the ink droplets and causing the ink droplets to strike the recording medium in unintended locations. The particulate debris should be cleaned from the surface and orifice to restore proper droplet formation and proper ink droplet trajectory. In the prior art, this cleaning is commonly accomplished by brushing, wiping, spraying, vacuum suction, and/or spitting of the ink through the orifice.

A representative inkjet print head cartridge cleaner is disclosed by U.S. Pat. No. 5,907,335 titled "Wet Wiping Printhead Cleaning System Using A Non-Contact Technique For Applying A Printhead Treatment Fluid" issued May 25, 335 in the name of Eric Joseph Johnson, et al. The Johnson, et al. patent discloses cleaning in printers employing a "wiper" which slidingly engages and wipes a nozzle orifice plate surface of a print head cartridge to remove excess ink and accumulated debris. Removal of excess ink and accumulated debris is intended to improve print head performance and print quality. According to the Johnson, et al. disclosure, the cleaning system comprises a print head service station including a source of treatment fluid located near a cap belonging to the service station. The cap is brought into sealing contact with the print head and vacuum is applied. A wiper, which is included in one embodiment of the service station, comes into contact with the print head for removing dried ink and debris. When the wiper is used, the treatment fluid lubricates the wiper to reduce wear of the wiper. Also, the treatment fluid dissolves some of the dried ink residue accumulated on the print head. In addition, the treatment fluid leaves a thin film, which does not dry, so that ink residue and other debris subsequently deposited on the print head over the layer of the fluid are more easily wiped-off.

Although prior art print head cartridge cleaning techniques, such as disclosed by the Johnson, et al. patent, may function satisfactorily, it has been observed that a tight seal between the cap and print head cartridge is sometimes prevented due to surface roughness, or other non-flatness, of the print head cartridge. In this regard, the surface of the print head cartridge may become unacceptably rough during fabrication of the print head or during subsequent mishandling of the print head. Having a non-tight seal between the cap and print head surface increases risk that cleaning fluid will leak from the service station, thereby reducing cleaning effectiveness. Also, ink leaking from one nozzle being cleaned to an adjacent nozzle not being cleaned may contaminate the ink in the adjacent nozzle. This is to be avoided, particularly in the case of multi-color ink jet printers wherein adjacent nozzles may contain differently colored inks. That is, ink leaking through the seal surrounding a nozzle having one color ink may migrate to the adjacent nozzle and contaminate the color of the ink in the adjacent nozzle. This is undesirable because such ink mixing will produce unwanted image artifacts on the recording medium. In addition, tolerances around the nozzles make it difficult to avoid the cap touching the nozzles. Such touching will tend to "wick-out" ink that then migrates to other nozzles. This result also encourages ink mixing, which is undesirable. Furthermore, the previously mentioned "non-flatness" of the surface presents a challenge for proper capping. Additionally, a non-tight seal occasioned by the rough surface makes it difficult to maintain a humid environment when the print head is parked and capped during non-use and also during active cleaning. This result leads to undesirable ink drying. Moreover, another disadvantage of a rough surface on the print head cartridge is that a rough surface on the print head cartridge can accelerate wiper wear. Hence, a problem in the art is a rough print head cartridge surface that prevents a proper seal with a service station cap such that print head cartridge cleaning is hampered, thereby ultimately reducing print head performance and print quality.

Therefore, what is needed is an inkjet printer cartridge adapted for enhanced cleaning thereof, and method of assembling the printer cartridge, in order to improve print head performance and print quality.

SUMMARY OF THE INVENTION

The present invention resides in an inkjet printer cartridge adapted for enhanced cleaning thereof, comprising an orifice plate and a platform surrounding the orifice plate, the platform defining a surface thereon having a predetermined surface roughness for sealably engaging a cap.

According to an aspect of the present invention, an inkjet printer cartridge comprises a cartridge body defining a chamber therein. A substrate is coupled to the cartridge body and has a hole therethrough in communication with the chamber. An orifice plate is coupled to the substrate and has an orifice therethrough aligned with the hole. In addition, the orifice plate has a first height. A platform, which has a second height, is coupled to the substrate and surrounds the orifice plate. The platform defines a relatively smooth surface thereon having a predetermined surface roughness for sealably engaging a service station cap movable into engagement with the surface of the platform. In this regard, the surface of the platform preferably has a surface roughness of between approximately 0.5 microinches and approximately 2.0 microinches. Moreover, the surface of the platform is also level for sealably engaging the cap. The second height of the platform can be greater, equivalent to, or less than the first height of the orifice plate.

A feature of the present invention is the provision of a platform surrounding the orifice plate and having a predetermined surface roughness.

An advantage of the present invention is that print head performance and print quality are improved.

Another advantage of the present invention is that risk of color cross-contamination during the cleaning process is reduced thereby reducing risk of image artifacts in multi-color ink jet printers.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

Figure 1:
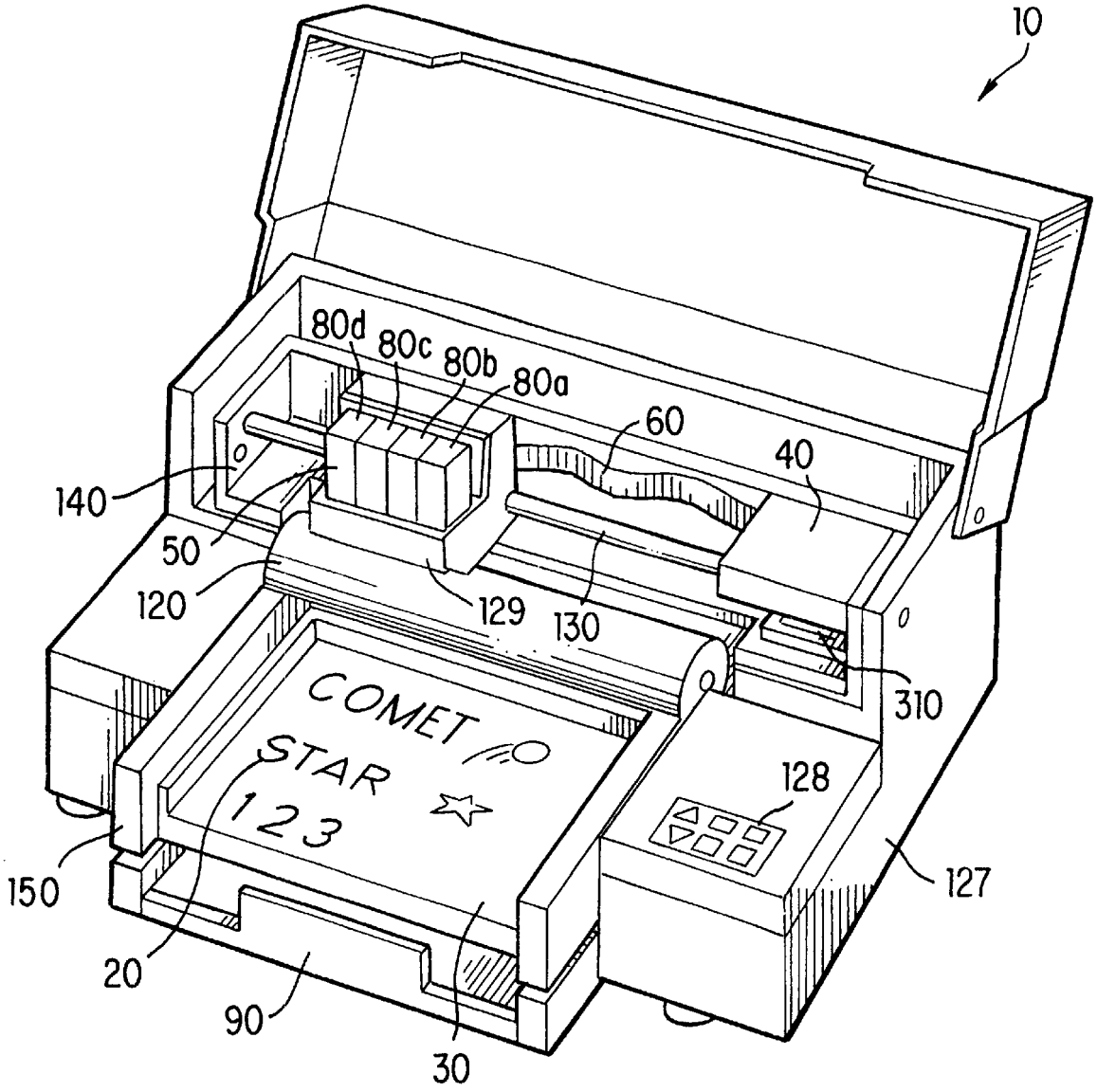
FIG. 1 is a view in perspective of a thermal inkjet printer with parts removed for clarity.
Figure 2:
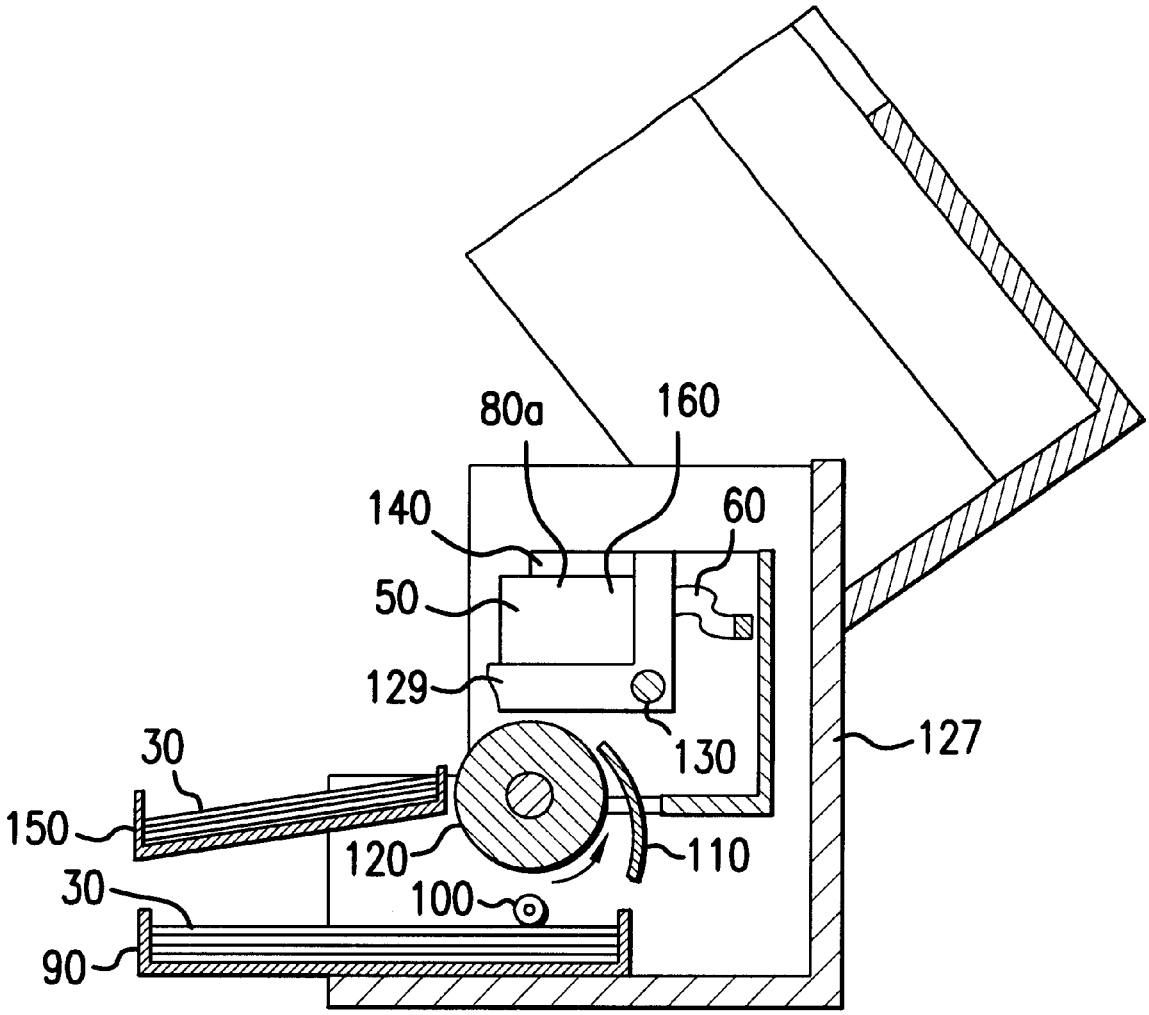
FIG. 2 is a view in elevation of the printer.

The present invention will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3 and 4, there is shown a thermal ink jet printer, generally referred to as 10, for printing an image 20 on a receiver 30. Receiver 30 may be paper or transparency or other material suitable for receiving image 20. An input source (not shown), which may be a computer, scanner, facsimile machine, or an all-in-one combination of these devices, provides raster image data or other form of digital image data to printer 10.

Referring again to FIGS. 1, 2, 3 and 4, the input source generates an output signal that is received by a controller 40, which is coupled to the input source. The controller 40 processes the output signal received from the input source and generates a controller output signal that is received by a thermal ink jet print head 50 electrically coupled to controller 40. Print head 50 is electrically coupled to controller 40, such as by means of an electrical cable 60 removably coupled to contact pads 65 (see FIG. 5). As shown in FIGS. 1, 2, 3, and 4, the controller 50 controls operation of print head 50 to eject an ink drop 70 therefrom in response to the output signal received from the input source. Moreover, print head 50 may comprise a plurality of print head cartridges 80*a*, 80*b*, 80*c*, and 80*d* containing differently colored inks, which may be magenta, yellow, cyan and black, respectfully, for forming a full-color version of image 20.

Still referring to FIGS. 1, 2, 3 and 4, individual sheets of receiver 30 are fed from a supply bin, such as a receiver sheet supply tray 90, by means of a picker mechanism 100. The picker mechanism 100 picks the individual sheets of receiver 30 from tray 90 and feeds the individual sheets of receiver 30 onto a guide 110 that is interposed between and aligned with print head 50 and picker mechanism 100. Guide 110 guides each sheet of receiver 30 into alignment with print head 50. Disposed opposite print head 50 is a rotatable platen roller 120 for supporting receiver 30 thereon and for transporting receiver 30 past print head 50, so that print head 50 may print image 20 on receiver 30. In this regard, platen roller 120 transports receiver 30 in direction of an arrow 125. The printer components mentioned hereinabove are housed in a printer housing 127 that includes an integrally connected control panel 128 connected to controller 40 for controlling image characteristics, such as image contrast, image size, number of copies and the like.

Referring yet again to FIGS. 1, 2, 3 and 4, during printing, print head 50 is driven transversely with respect to receiver 30 preferably by means of a motorized continuous belt and pulley assembly (not shown). The belt and pulley assembly comprises a continuous belt (not shown) affixed to a carriage 129 that carries print head 50 and a motor (also not shown) engaging the belt. The belt extends traversely across receiver 30 and the motor engages the belt by means of at least one pulley (not shown). As the motor rotates the pulley, the belt also rotates. As the belt rotates, print head 50 traverses receiver 30 because print head 50 is affixed to the belt, which extends traversely across receiver 30. Moreover, print head 50 is itself supported by a slide bar 130 that slidably engages and supports print head 50 as print head 50 traverses receiver 30. Slide bar 130 in turn is supported by a frame 140 connected to ends of slide bar 130. Of course, controller 50 may be coupled to picker mechanism 100, platen roller 120, and the motor, as well as print head 50, for synchronously controlling operation of picker mechanism 80, platen roller 120, the motor, and print head 50. Each time print head traverses receiver 30, a swath of image information is printed onto receiver 30. After each swath of image information is printed onto receiver 30, platen roller 120 is rotated in order to increment receiver 30 a predetermined distance in the direction of arrow 125. After receiver 30 is incremented the predetermined distance, print head 50 is again caused to traverse receiver 30 to print another swath of image information. Image 20 is formed after all desired swaths of printed information are printed on receiver 30. After image 20 is printed on receiver 30, the receiver 30 exits printer 10 to be deposited in an output bin 150 for retrieval by an operator of printer 10.

Figure 3:
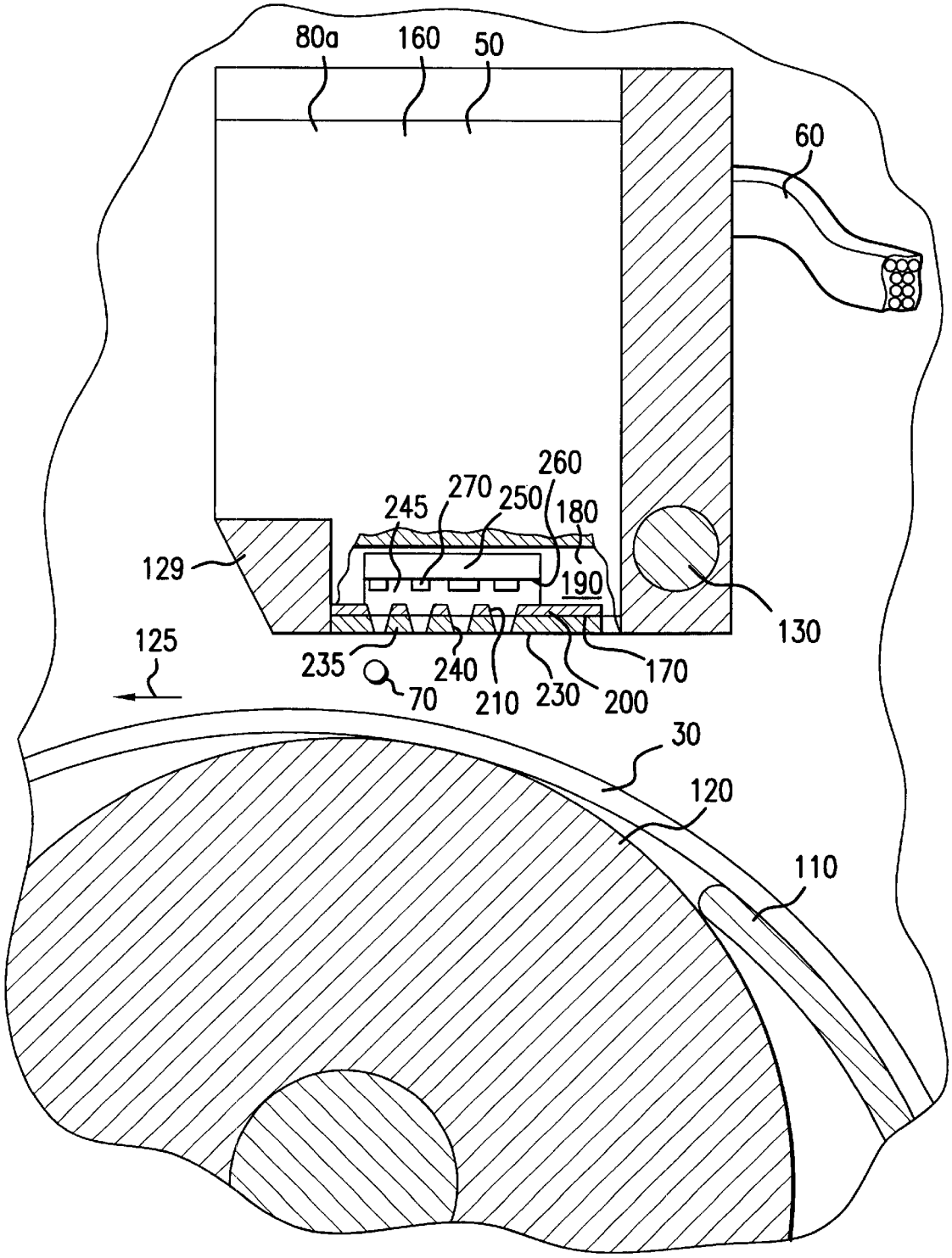
FIG. 3 is a fragmentary view in partial elevation of a print head cartridge and platen roller belonging to the printer.
Figure 4:
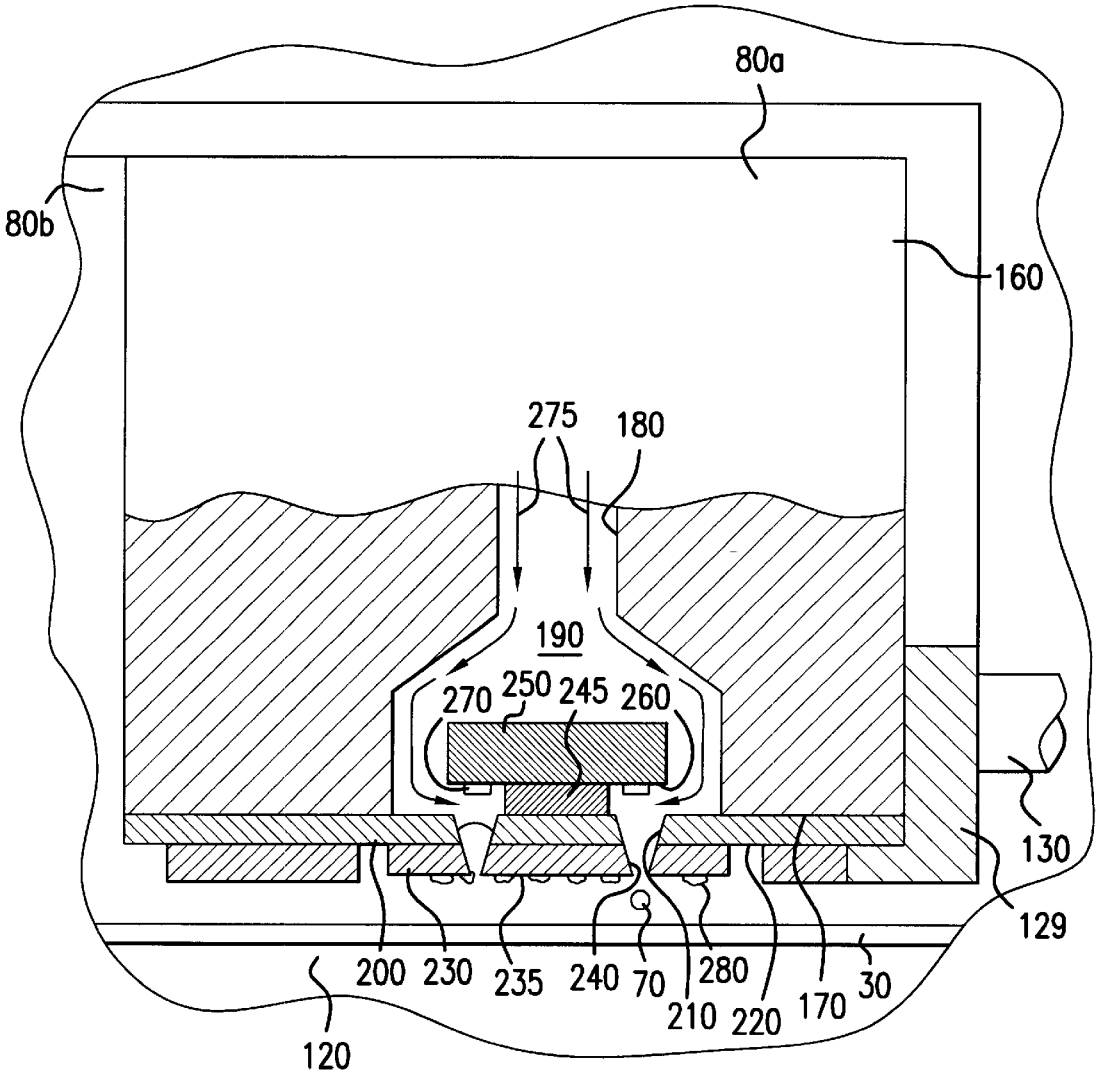
FIG. 4 is a fragmentary view in partial elevation of the print head cartridge having an orifice plate and particulate debris adhered to the orifice plate.
Figure 5:
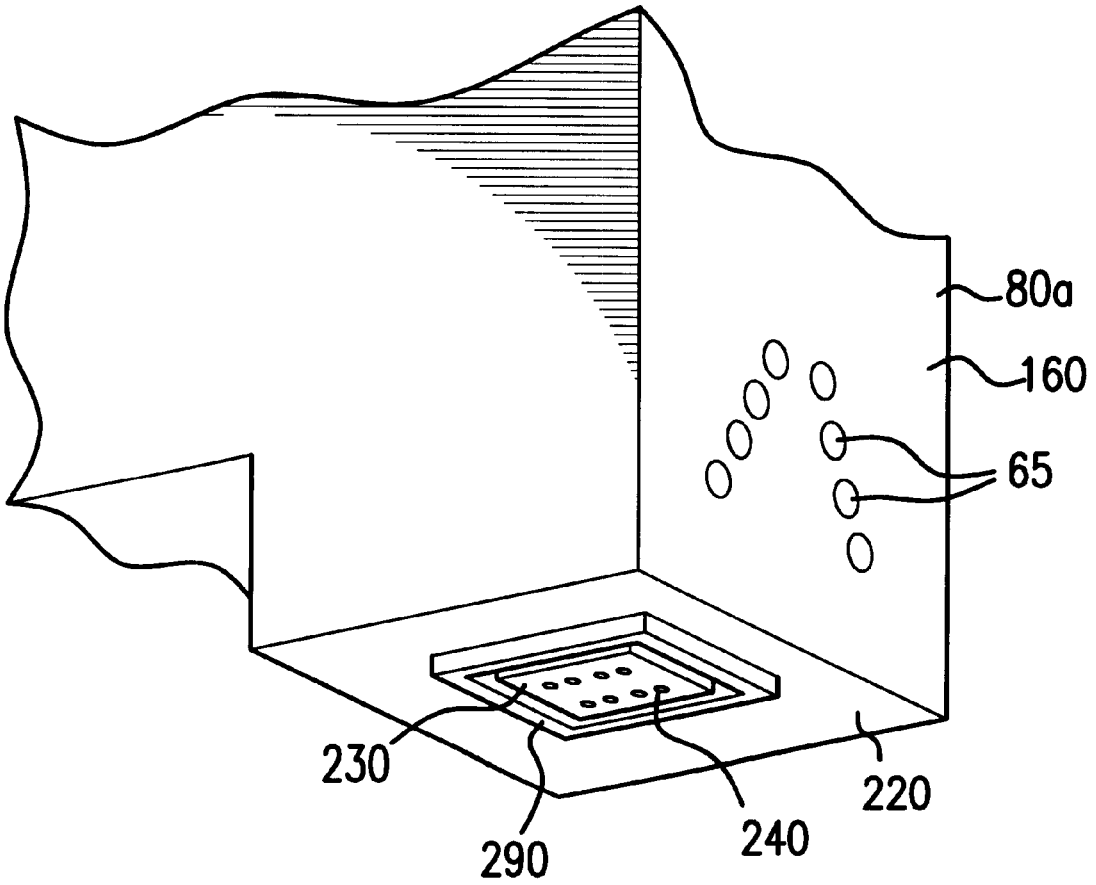
FIG. 5 is a view in perspective of a platform coupled to a surface of the print head cartridge and surrounding the orifice plate.

As best seen in FIGS. 3 and 4, print head 50 comprises the previously mentioned print head cartridges 80*a*/*b*/*c*/*d* (only cartridges 80*a*/*b* being shown) coupled side-by-side in tandem. Each of cartridges 80*a*/*b*/*c*/*d* belonging to print head 50 comprises a cartridge body 160 defining a surface 170 thereon and an elongate chamber 180 therein in communication with surface 170. For reasons disclosed more fully hereinbelow, chamber 180 is capable of receiving an ink body 190 from which image 20 will be formed. Coupled to surface 170 is a generally rectangular substrate 200 having a plurality of spaced-apart and co-linearly aligned, preferably frusto-conical, holes 210 therethrough in communication with chamber 180. Substrate 200 defines a relatively rough surface 220 thereon having a surface roughness of between approximately 2.0 microinches and approximately 25.0 microinches. Coupled to surface 220 of substrate 200 is a generally rectangular orifice plate 230 having a plurality of spaced-apart, preferably frusto-conical, orifices 240 aligned with holes 210. Orifice plate itself defines an exterior surface 235 thereon and may be centrally-disposed on surface 220, if desired.

Referring again to FIGS. 3 and 4, horizontally-disposed in chamber 180 and connected to substrate 200, such as by means of a support member 245, is a generally rectangular die or rafter member 250. Rafter member 250 has an underside 260 for reasons disclosed presently. In this regard, attached to underside 270 of rafter member 220 and therefore disposed in chamber 180 is a plurality of thermal resistive heater elements or thin-film resistors 240 aligned with respective ones of holes 210, for locally boiling ink body 190 in the vicinity of holes 210. Resistors 270 are each electrically connected to controller 50, so that controller 40 selectively controls flow of electrical energy to resistors 270 in response to output signals received from the previously mentioned input source. In this regard, when electrical energy momentarily flows to any of resistors 270, the resistor 270 locally heats ink body 190 causing a vapor bubble (not shown) to form adjacent to resistor 270. The vapor bubble pressurizes chamber 180 by displacing ink body 190 to squeeze ink drop 70 from ink body 190. The ink drop travels through hole 210 and orifice 240 to be intercepted by receiver 30. After a predetermined time, controller 40 ceases supplying electrical energy to resistor 270. The vapor bubble will thereafter collapse due to absence of energy input to ink body 190 and ink will subsequently refill chamber 180 generally along flow lines illustrated by an arrow 275.

Of course, inkjet print head cartridges 80*a*/*b*/*c*/*d* are exposed to the environment where the inkjet printing of image 30 occurs. Thus, orifices 240 and are exposed to dried ink particles and many kinds of air born particulates, such as dust, dirt and paper fibers, collectively referred to herein as particulate debris. Such particulate debris may accumulate to form encrustations on surfaces around the orifices and may accumulate in the orifices and chambers themselves. Indeed, such particulate debris may form an interference burr that blocks orifice 240 or that alters surface wetting to inhibit proper formation of ink droplet 70. Such particulate debris should be cleaned from surface 235 and orifice 240 to restore proper droplet formation. Typically, a cap having a wiper therein and belonging to a service station is brought into sealing contact with print head 50. Although, the wiper is disclosed herein as being in the cap, the wiper may instead be disposed outside the cap. The wiper, which may be disposed in the cap together with a cleaning fluid, scrubs the print head for removing the particulate debris.

However, it has been observed that a tight seal between the cap and print head cartridge 80*a*/*b*/*c*/*d* is sometimes prevented due to surface roughness of the print head cartridge 80*a*/*b*/*c*/*d*. Having a non-tight seal between the cap and print head cartridge surface increases risk that fluid, either cleaning and/or ink, will leak from the service station, thereby reducing cleaning effectiveness. Also, fluid leaking from one orifice being cleaned to an adjacent orifice not being cleaned may contaminate the ink in the adjacent orifice. Moreover, a rough surface on the print head cartridge can accelerate wiper wear. Hence, it would be desirable to provide a proper seal between the print head cartridge and the service station cap such that print head cartridge cleaning is unhampered, thereby ultimately increasing print head performance and print quality.

Figure 6:
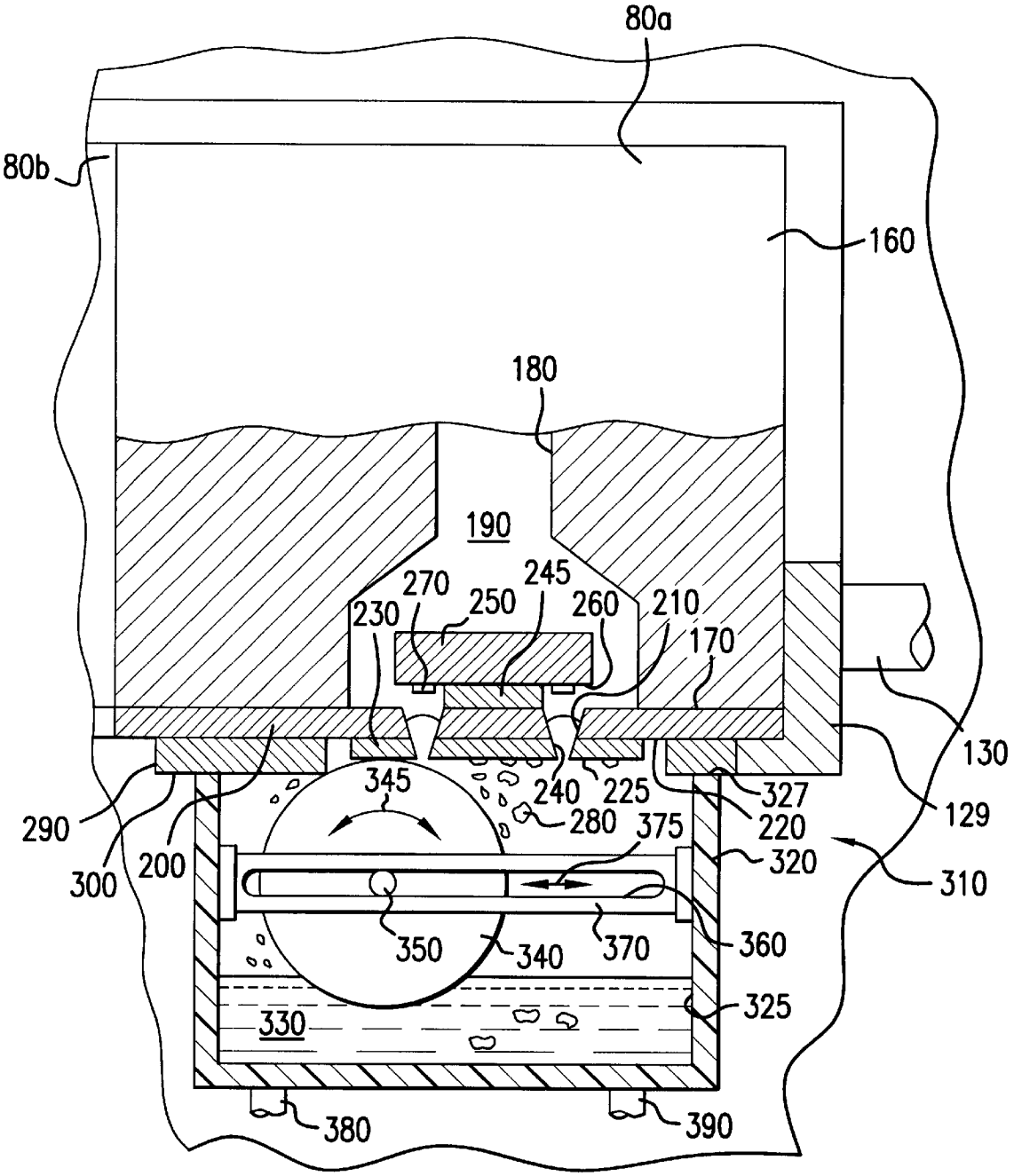
FIG. 6 is a view in partial elevation of a cap belonging to a print head cartridge cleaning service station shown removing the particulate matter from the orifice plate, the cap sealably engaging the platform.
Figure 7A:
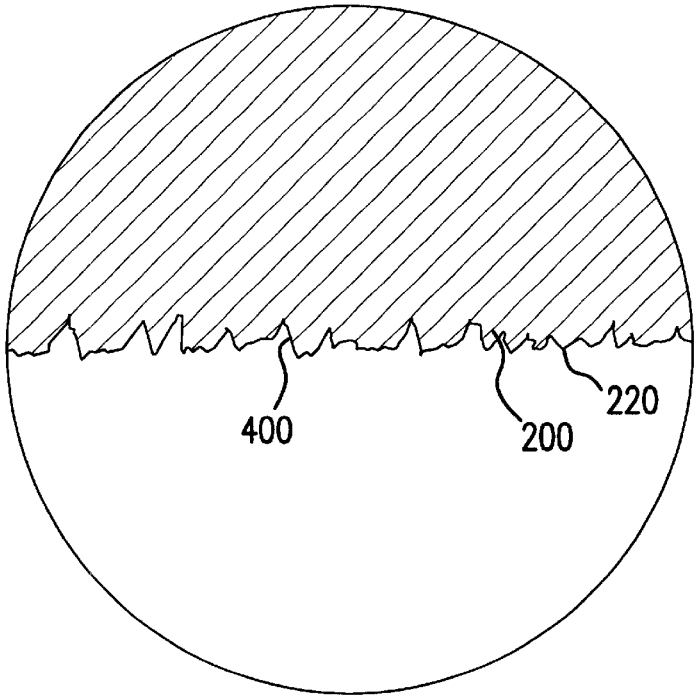
FIG. 7A is a magnified view of a surface of a substrate belonging to the print head cartridge.
Figure 7B:
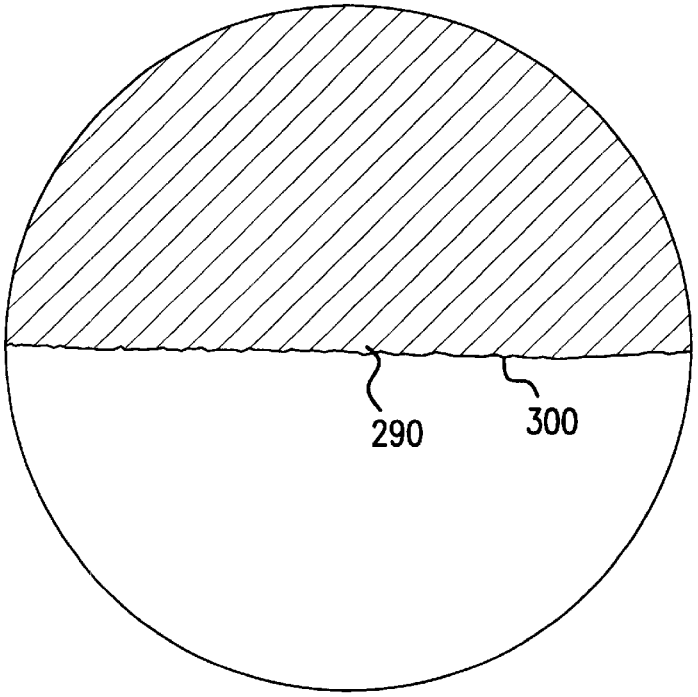
FIG. 7B is a magnified view of a surface of the platform.

Therefore, referring to FIGS. 5, 6, 7A, 7B and 8, a generally rectangular platform 290 surrounds orifice plate 230 and is coupled to surface 220 of substrate 200. Platform 290, which may be formed of an acetate-bearing material, ceramic material, plastic or any smooth and flat material, defines a relatively smooth surface 300 thereon having a surface roughness of between approximately 0.5 microinches and approximately 2.0 microinches for reasons disclosed hereinbelow. In this regard, surface 300 may be formed by a suitable machining operation, such as lapping, polishing, or honing or any appropriate machining operation providing a smooth finish. Alternatively, platform 290 may be a molded member having a smooth and flat surface. Moreover, surface 300 should be level (i.e., not canted) for reasons disclosed hereinbelow. In addition, substrate 200 has a first height H1 and platform 290 has a height H2. Height H2 may be greater than, equivalent to, or less than height H1. As best illustrated in FIGS. 7A and 7B, surface 300 of platform 290 has a surface roughness less than the surface roughness of surface 220 that belongs to substrate 200.

Figure 8:
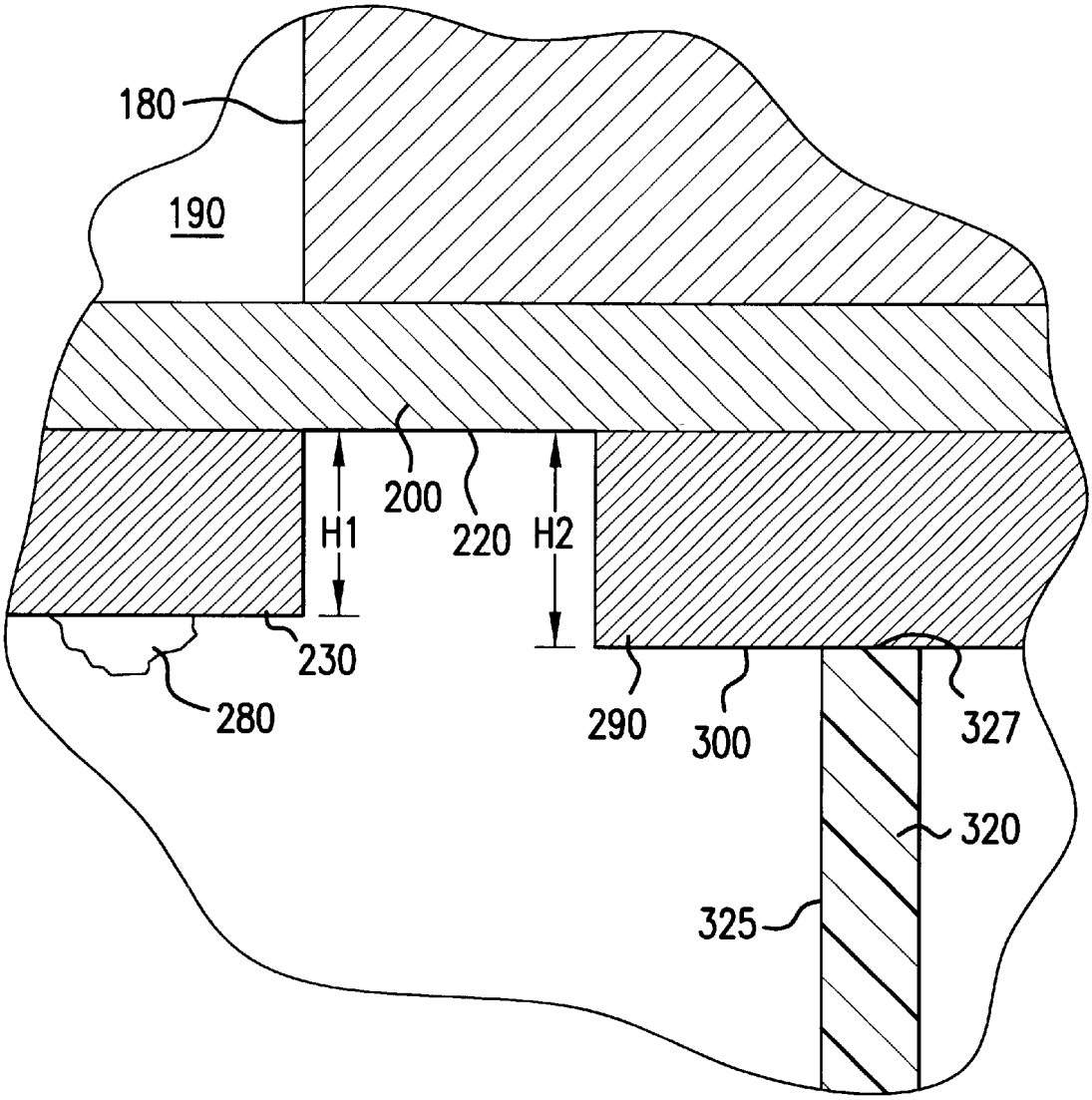
FIG. 8 is a fragmentary view in elevation of the cap sealably engaging the surface of the platform.

Referring again to FIGS. 5, 6, 7A, 7B and 8, cartridge 80*a* is slidably moved along slide bar 130 into alignment with a print head service station, generally referred to as 310, and positioned thereabove to await cleaning or removal of particulate debris 280 from orifice plate 230. Cartridge 80*a* may be moved along slide bar 130 by means of the previously mentioned motor (not shown) which is coupled thereto. Cartridge 80*a* is shown in alignment with service station 310; however, any of cartridges 80*a*/*b*/*c*/*d* may be brought into alignment with service station 310 for cleaning. Service station 310, which forms no part of the present invention, may take any one of several configurations known in the art, such as the configuration disclosed by U.S. Pat. No. 5,907,335 titled "Wet Wiping Printhead Cleaning System Using A Non-Contact Technique For Applying A Printhead Treatment Fluid" issued May 25, 335 in the name of Eric Joseph Johnson, et al. The configuration illustrated in FIGS. 6 and 8 is representative only.

Still referring to FIGS. 5, 6, 7A, 7B and 8, service station includes a cup-shaped cap 320 preferably formed of an elastic material, such as rubber. Cap 320 defines a rim 327 therearound. Disposed in an interior 325 of cap 320 is a reservoir of cleaning fluid 330, which may be a PEG of molecular weight 400. Also disposed in interior 325 of cap 320 is a generally cylindrical wiper 340 rotatable in direction of an arrow 345. Wiper 340 itself is preferably at least the length of rectangularly-shaped orifice place 230 and may be a brush having fine bristles, a scraper blade having a honed edge, or any wiper suitable for removing particulate debris 280 from surface 225 of orifice plate 290. In this regard, cylindrical wiper 340 includes a centrally-disposed spindle 350 longitudinally therethrough. Spindle 350 engages a track 360 formed in a rail 370 that spans interior 325 of cap 320. Spindle 350 is operable by means of a reversible motor (not shown) connected thereto for rotating wiper 340 in direction of arrow 345. Moreover, the motor is also operable to move wiper along track 360 to-and-fro in direction of an arrow 375, so that wiper cleans or removes particulate debris 280 from orifice plate 230. In addition, a portion of wiper 340 is in fluid communication with the cleaning fluid 330 and "picks-up" a sufficient amount of cleaning fluid 330 as wiper 340 rotates. Wiper 340 carries this amount of cleaning fluid 330 to surface 225 of orifice plate to assist wiper 340 in cleaning surface 225. In the configuration of service station 310 shown, an inlet pipe 380 in communication with interior 325 may be provided for admitting the cleaning fluid 330 into cap 320 and an outlet pipe 390 also in communication with interior 325 may also be provided for exit of cleaning fluid 330 and particulate debris 280 from cap 320.

Referring yet again to FIGS. 5, 6, 7A, 7B and 8, platform 290 surrounds orifice plate 230 to provide relatively smooth surface 300 that can accommodate a seal-tight relationship with rim 327 of cap 320. Otherwise engaging rim 327 of cap 320 with surface 220 of bearing plate 220 may not provide the necessary seal because of the relatively rough surface 220 of bearing plate 200. Also, with reference to FIG. 7A, the relatively large value of surface roughness for surface 220 gives rise to a multiplicity of canals or cavities 400 that prevent a suitable seal with rim 327 of cap 320. In addition, cavities 400 provide an unintended flow path of cleaning fluid from service station 310. As can be seen in FIG. 7B, presence of cavities 400 in surface 300 has been substantially eliminated, thereby enabling a suitable seal with rim 327 and also reducing risk of the unintended flow path of cleaning fluid and/or ink from service station 310. As previously mentioned, having a non-tight seal between the cap and print head surface increases risk that ink will leak past cap 320 from one nozzle being cleaned to an adjacent nozzle not being cleaned. This may occur, for example, when cap 320 touches the nozzle and "wicks-out" ink. In this case, ink from one nozzle will contaminate the ink in the adjacent nozzle, a highly undesirable result, particularly in the case of multi-color inkjet printers.

It may be appreciated from the description hereinabove that an advantage of the present invention is that print head performance and print quality are improved. This is so because presence of the platform provides an improved seal between the service station cap and the print head cartridge in order to increase cleaning efficiency, which in turn facilitates removal of particulate matter from the orifice plate.

Another advantage of the present invention is that risk of color cross-contamination during the cleaning process is reduced thereby reducing risk of image artifacts in multi-color ink jet printing. This is so because the tight seal provided by the platform prevents fluid leaking from one orifice being cleaned, which may contain one color, to an adjacent orifice not being cleaned, which may contain a different color. Such leakage would otherwise contaminate the ink in the adjacent orifice.

While the invention has been described with particular reference to its preferred embodiments, it may be understood by those skilled in the art that various changes may be made and equivalents may be substituted for elements of the preferred embodiments without departing from the invention. For example, although the present invention is disclosed herein with reference to thermal inkjet printer cartridges, the invention is also useable with piezoelectric inkjet printer cartridges, as well.

Therefore, what is provided is an inkjet printer cartridge adapted for enhanced cleaning thereof, and method of assembling the printer cartridge, in order to improve print head performance and print quality.

PARTS LIST

| | |
|---|---|
| H1 | height of substrate |
| H2 | height of platform |
| 10 | inkjet printer |
| 20 | image |
| 30 | receiver |
| 40 | controller |
| 50 | print head |
| 60 | electrical cable |
| 65 | contact pads |
| 70 | ink drop |
| 80a/b/c/d | inkjet cartridges |
| 90 | receiver sheet supply tray |
| 100 | picker mechanism |
| 110 | guide |
| 120 | platen roller |
| 125 | arrow |
| 127 | housing |
| 128 | control panel |
| 129 | carriage |
| 130 | slide bar |
| 140 | frame |
| 150 | output bin |
| 160 | cartridge body |
| 170 | surface |
| 180 | chamber |
| 190 | ink body |
| 200 | substrate |
| 210 | holes |
| 220 | surface |
| 230 | orifice plate |
| 240 | orifices |
| 245 | support member |
| 250 | rafter member |
| 260 | underside |
| 270 | resistors |
| 275 | arrow |
| 280 | particulate debris |
| 290 | platform |
| 300 | surface |
| 310 | print head service station |
| 320 | cap |
| 325 | interior |
| 327 | rim |
| 330 | reservoir |
| 340 | wiper |
| 345 | arrow |
| 350 | spindle |
| 360 | track |
| 370 | rail |
| 375 | arrow |
| 380 | inlet pipe |
| 390 | outlet pipe |
| 400 | cavities |

What is claimed is:

1. An inkjet printer cartridge adapted for enhanced cleaning thereof, comprising:

a. an orifice plate; and b. a platform surrounding said orifice plate, said platform defining a surface thereon having a predetermined surface roughness for sealably engaging a cap.

2. The printer cartridge of claim 1, wherein said platform has the predetermined surface roughness of between approximately 0.5 microinches and approximately 2.0 microinches.

3. An inkjet printer cartridge adapted for enhanced cleaning thereof, comprising:

a. a cartridge body defining a chamber therein;

b. a substrate coupled to said cartridge body and having a hole therethrough in communication with the chamber, said substrate defining a first surface thereon having a first surface roughness;

c. an orifice plate coupled to said substrate and having an orifice therethrough aligned with the hole, said orifice plate having a first height; and d. a platform coupled to said substrate and surrounding said orifice plate, said platform defining a second surface thereon having a second surface roughness less than the first surface roughness for sealably engaging a cap.

4. The printer cartridge of claim 3, wherein said platform has a second height greater than the first height.

5. The printer cartridge of claim 3, wherein said platform has a second height equivalent to the first height.

6. The printer cartridge of claim 3, wherein said platform has a second height less than the first height.

7. The printer cartridge of claim 3, wherein said substrate has the first surface roughness of between approximately 2.0 microinches and approximately 25.0 microinches.

8. The printer cartridge of claim 3, wherein said platform has the second surface roughness of between approximately 0.5 microinches and approximately 2.0 microinches.

9. The printer cartridge of claim 3, wherein said platform has the second surface thereof level for sealably engaging the cap.

10. The printer cartridge of claim 3, wherein said platform is an acetate-bearing material having a predetermined coefficient of sliding friction for prolonging operational life-time of a wiper disposed in the cap, the wiper being adapted to scrub the second surface defined by said platform.

11. A method of assembling an inkjet printer cartridge adapted for enhanced cleaning thereof, comprising the steps of:

a. providing an orifice plate; and b. surrounding the orifice plate with a platform, the platform defining a surface thereon having a predetermined surface roughness for sealably engaging a cap.

12. The method of claim 11, wherein the step of surrounding the orifice plate with the platform comprises the step of providing the platform with the predetermined surface roughness of between approximately 0.5 microinches and approximately 2.0 microinches.

13. A method of assembling an inkjet printer cartridge adapted for enhanced cleaning thereof, comprising:

a. providing a cartridge body defining a chamber therein;

b. coupling a substrate to the cartridge body, the substrate having a hole therethrough in communication with the chamber, the substrate defining a first surface thereon having a first surface roughness;

c. coupling an orifice plate to the substrate, the orifice plate having a first height and an orifice therethrough aligned with the hole; and d. coupling a platform to the substrate, the platform surrounding the orifice plate, the platform defining a second surface thereon having a second surface roughness less than the first surface roughness for sealably engaging a cap.

14. The method of claim 13, wherein the step of coupling the platform comprises the step of providing the platform with a second height greater than the first height.

15. The method of claim 13, wherein the step of coupling the platform comprises the step of providing the platform with a second height equivalent to the first height.

16. The method of claim 13, wherein the step of coupling the platform comprises the step of providing the platform with a second height less than the first height.

17. The method of claim 13, wherein the step of coupling the substrate comprises the step of providing the substrate with the first surface roughness of between approximately 2.0 microinches and approximately 25.0 microinches.

18. The method of claim 13, wherein the step of coupling the platform comprises the step of providing the platform with the second surface roughness of between approximately 0.5 microinches and approximately 2.0 microinches.

19. The method of claim 13, wherein the step of coupling the platform comprises the step of providing the platform with the second surface thereof level for sealably engaging the cap.

20. The method of claim 13, wherein the step of coupling the platform comprises the step of providing the platform in the form of an acetate-bearing material having a predetermined coefficient of sliding friction for prolonging operational life-time of a wiper disposed in the cap, the wiper being adapted to scrub the second surface defined by the platform.

* * * * *